US007690946B2

(12) United States Patent
Knaub et al.

(10) Patent No.: US 7,690,946 B2
(45) Date of Patent: Apr. 6, 2010

(54) CONTACT ORGANIZER FOR AN ELECTRICAL CONNECTOR

(75) Inventors: John E. Knaub, Etters, PA (US); Richard Elof Hamner, Hummelstown, PA (US); James Lee Fedder, Etters, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 12/181,403

(22) Filed: Jul. 29, 2008

(65) Prior Publication Data

US 2010/0029105 A1 Feb. 4, 2010

(51) Int. Cl.
*H01R 12/00* (2006.01)

(52) U.S. Cl. ..... 439/607.07; 439/79

(58) Field of Classification Search ..... 439/607.07, 439/79, 607.06, 381

See application file for complete search history.

(56) References Cited

U.S. PATENT DOCUMENTS

| | | | | |
|---|---|---|---|---|
| 4,290,661 | A | 9/1981 | Burns | |
| 4,488,768 | A | 12/1984 | Sigmon | |
| 5,037,334 | A | 8/1991 | Viselli et al. | |
| 5,348,488 | A * | 9/1994 | Green et al. | 439/140 |
| 5,496,183 | A | 3/1996 | Soes et al. | |
| 5,692,912 | A * | 12/1997 | Nelson et al. | 439/79 |
| 6,494,724 | B1 * | 12/2002 | Bixler et al. | 439/79 |
| 6,638,104 | B2 * | 10/2003 | Hashimoto et al. | 439/567 |
| 6,755,691 | B2 * | 6/2004 | Sasame et al. | 439/607.27 |
| 6,821,161 | B1 * | 11/2004 | Cao | 439/701 |
| 6,923,662 | B2 * | 8/2005 | Sasame et al. | 439/79 |
| 6,932,626 | B2 | 8/2005 | Costello et al. | |
| 6,932,649 | B1 | 8/2005 | Rothermel | |
| 6,955,565 | B2 | 10/2005 | Lloyd et al. | |
| 7,131,870 | B2 | 11/2006 | Whiteman, Jr. et al. | |
| 7,172,461 | B2 | 2/2007 | Davis et al. | |
| 7,267,515 | B2 | 9/2007 | Lappohn | |
| 7,267,616 | B2 | 9/2007 | Lappohn | |
| 7,285,018 | B2 | 10/2007 | Kenny | |
| 7,331,801 | B1 * | 2/2008 | Eichorn | 439/79 |
| 2005/0026474 | A1 * | 2/2005 | Li | 439/79 |
| 2006/0003687 | A1 * | 1/2006 | Dube | 454/274 |
| 2006/0063404 | A1 * | 3/2006 | Minich et al. | 439/79 |
| 2006/0205264 | A1 * | 9/2006 | Katsuma | 439/381 |

* cited by examiner

*Primary Examiner*—Gary F. Paumen

(57) ABSTRACT

A connector system includes a connector assembly and a contact organizer. The connector assembly includes a mounting end and a plurality of contacts protruding from the mounting end. The contact organizer includes a top side, a bottom side and a plurality of channels extending between the top and bottom sides. The contact organizer is movable with respect to the connector assembly between a supporting position and a seated position. When the contact organizer is in the supporting position, the contacts at least partially extend through the channels. When the contact organizer is moved to the supporting position, the contact organizer is moved toward the mounting end of the connector assembly until the top side of the contact organizer engages the mounting end.

20 Claims, 6 Drawing Sheets

CONTACT ORGANIZER FOR AN ELECTRICAL CONNECTOR

BACKGROUND OF THE INVENTION

The subject matter herein relates generally to electrical connectors, and more particularly, to a connector having a contact organizer.

With the ongoing trend toward smaller electrical components such as processors used in computers, routers, switches, and the like, electrical connectors continue to become smaller. As connectors become smaller, the contacts used in the connectors also become smaller. Smaller contacts are more easily bent, buckled and otherwise damaged during handling of the connectors. For example, the contacts can be more easily bent during shipping of the connectors. The contacts also are more easily bent and buckled during mounting of the connectors to circuit boards and other devices. For example, the contacts may buckle during seating of a connector in a circuit board if the contacts are not properly aligned with respect to the circuit board.

Thus, a need exists for connectors with smaller contacts that are better protected from damage during handling and mounting of the connectors. Meeting such a need can allow for the size of the contacts and the connectors to continue to decrease while protecting the contacts, from mechanical damage.

BRIEF DESCRIPTION OF THE INVENTION

In one embodiment, a connector system includes a connector assembly and a contact organizer. The connector assembly includes a mounting end and a plurality of contacts protruding from the mounting end. The contact organizer includes a top side, a bottom side and a plurality of channels extending between the top and bottom sides. The contact organizer is movable with respect to the connector assembly between a supporting position and a seated position. When the contact organizer is in the supporting position, the contacts at least partially extend through the channels. When the contact organizer is moved to the seated position, the contact organizer is moved toward the mounting end of the connector assembly until the top side of the contact organizer engages the mounting end.

In another embodiment, another connector system includes a connector assembly and a contact organizer. The connector assembly includes a mounting end and a plurality of chicklets each holding a plurality of contacts protruding from the mounting end. The connector assembly is configured to be mounted to a circuit board. The contact organizer extends between opposing top and bottom sides and includes a plurality of channels extending between the top and bottom sides. The contact organizer receives the contacts from the chicklets. The contacts slide through the cavities to mate with the circuit board.

In another embodiment, a contact organizer is configured to receive contacts protruding from a mounting end of a connector assembly. The contact organizer includes a body having a top side, a bottom side opposite to the top side, and a plurality of channels extending between the top and bottom sides. The channels are configured to receive the contacts and are oriented to align the contacts with respect to cavities in the circuit board. The contact organizer is movable with respect to the connector assembly during mating with the circuit board between a supporting position and a seated position. When the contact organizer is in the supporting position, the contacts at least partially extend through the channels. When the contact organizer is moved to the supporting position, the contact organizer is moved toward the mounting end of the connector assembly until the top side engages the mounting end.

DETAILED DESCRIPTION OF THE INVENTION

Figure 1:
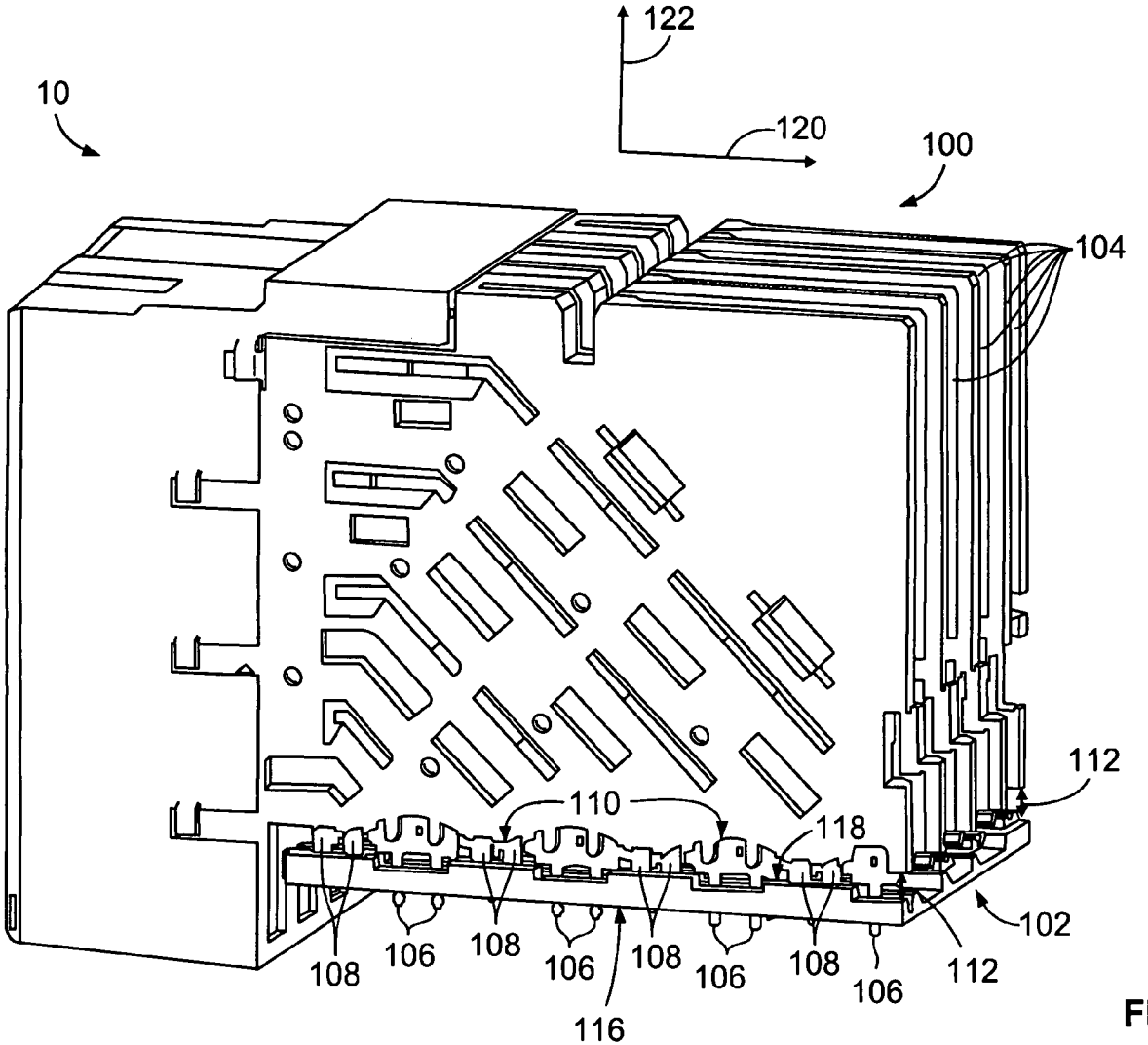
FIG. 1 illustrates a connector system according to one embodiment.

FIG. 1 illustrates a connector system 10 according to one embodiment. The connector system 10 includes a connector assembly 100 and a contact organizer 102. The connector assembly 100 includes a plurality of chicklets 104 each having a plurality of ground contacts 106 and/or signal contacts 108 held therein. The chicklets 104 are substantially planar in a plane defined by a longitudinal direction 120 and a transverse direction 122 in the illustrated embodiment. The connector assembly 100 may be mounted to a circuit board 200 (shown in FIG. 2) by seating the ground and signal contacts 106, 108 in the circuit board 200. For example, the connector assembly 100 may be mounted to the circuit board 200 by inserting the ground and signal contacts 106, 108 into corresponding ground and signal contact cavities 202, 204 (shown in FIG. 2). Once mounted to the circuit board 200, the ground contacts 106 may electrically connect a shield (not shown) of the connector assembly 100 to an electric ground of the circuit board 200. The signal and/or ground contacts 108, 106 may electrically connect the connector assembly 100 to one or more conductive traces (not shown) in the circuit board 200, for example.

The connector assembly 100 includes a mounting end 110 from which the ground and signal contacts 106, 108 protrude. For example, each of the chicklets 104 may include a corresponding part of the mounting end 110. The mounting end 110 may define the mounting interface of the connector assembly 100. The mounting end 110 generally faces the circuit board 200 (shown in FIG. 2) and the ground and signal contacts 106, 108 extend from the mounting end 110 to engage the circuit board 200.

In the illustrated embodiment, the contact organizer 102 is shown in a supporting position. The ground and signal contacts 106, 108 are partially inserted into and supported by the contact organizer 102 through a top side 118 of the contact organizer 102. The ground and signal contacts 106, 108 for a plurality of the chicklets 104 are inserted into, and supported by, a single contact organizer 102. In the supporting position, a gap 112 is provided between the contact organizer 102 and the mounting end 110 of the connector assembly 100. Alternatively, the top side 118 is located proximate to the mounting end 110 of the connector assembly 100 such that at least a portion of the mounting end 110 directly contacts or engages a portion of the top side 118. A portion of the ground contacts 106 may protrude from a bottom side 116 of the contact organizer 102 that opposes the top side 118. The signal contacts 108 do not protrude from the bottom side 116, or may protrude from the bottom side 116 by a distance that is less than the distance that the ground contacts 106 protrude from the bottom side 116. The bottom side 116 is the side of the contact organizer 102 that directly contacts or engages the circuit board 200 (shown in FIG. 2) when the connector system 10 is seated or mounted to the circuit board 200.

In the supporting position, the ground and signal contacts 106, 108 are supported by the contact organizer 102. For example, only a portion of the ground and signal contacts 106, 108 extend beyond the bottom side 116 of the contact organizer 102, such that a substantial portion of the ground and signal contacts 106, 108 are surrounded by, and thus protected by, the contact organizer 102. Optionally, the contact organizer 102 may entirely surround the distal ends of the ground and/or signal contacts 106, 108 to protect the ground and signal contacts 106, 108. Without the contact organizer 102, a greater portion of the ground and signal contacts 106, 108 would be exposed and thus more susceptible to bending or damage during handling, storage or shipping of the connector assembly 100. By inserting the ground and signal contacts 106, 108 into the contact organizer 102, the contact organizer 102 can provide additional mechanical support or stability to the ground and signal contacts 106, 108 prior to seating the connector assembly 100 on the circuit board 200.

Figure 2:
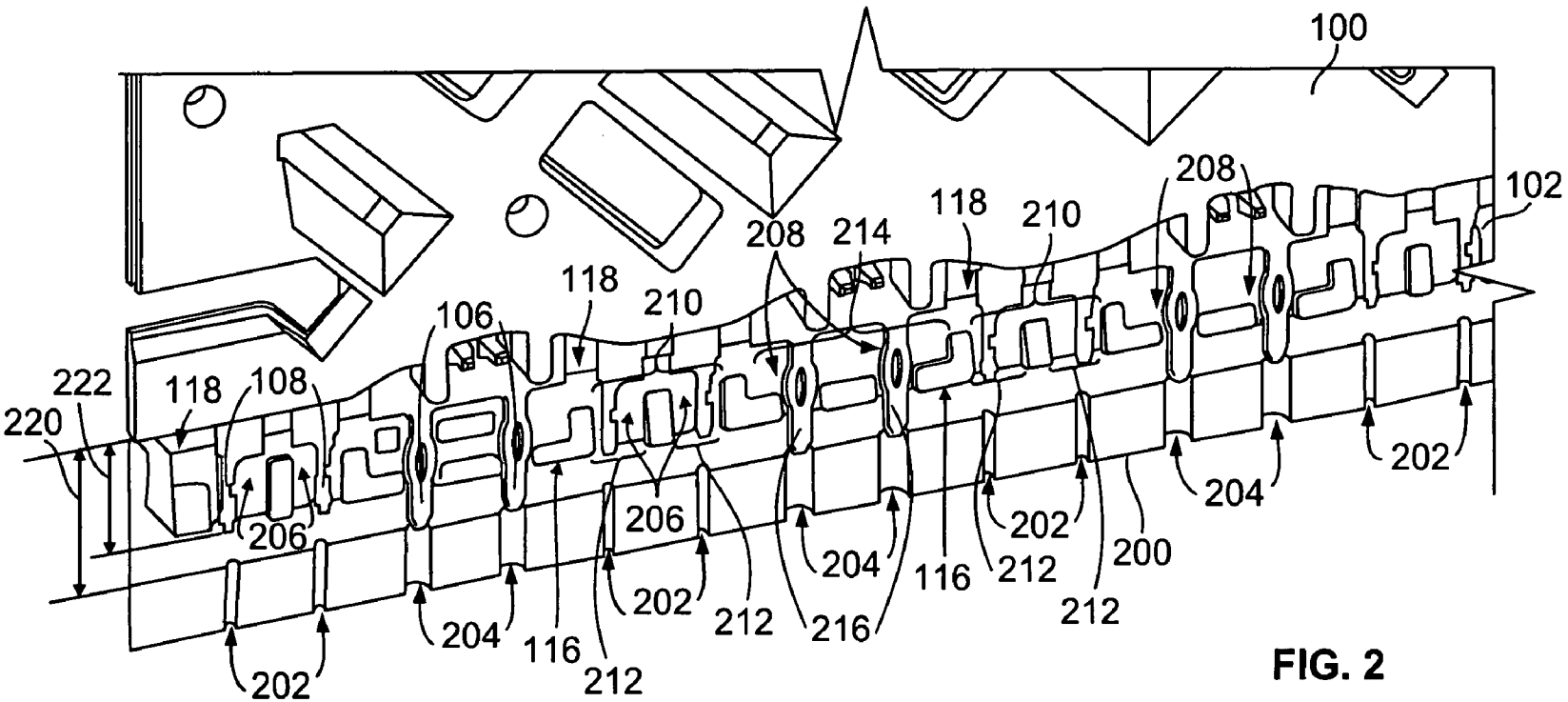
FIG. 2 is a partial cut-away view of a connector assembly shown in FIG. 1, a contact organizer shown in FIG. 1 and a circuit board with the contact organizer in a supporting position.

FIG. 2 is a partial cut-away view of the connector assembly 100, the contact organizer 102 and the circuit board 200 with the contact organizer 102 in the supporting position. As shown in FIG. 2, the ground contacts 106 extend from the mounting end 110 of the connector assembly 100 by a distance 220 that is greater than the distance 222 that the signal contacts 108 extend from the mounting end 110.

Figure 5:
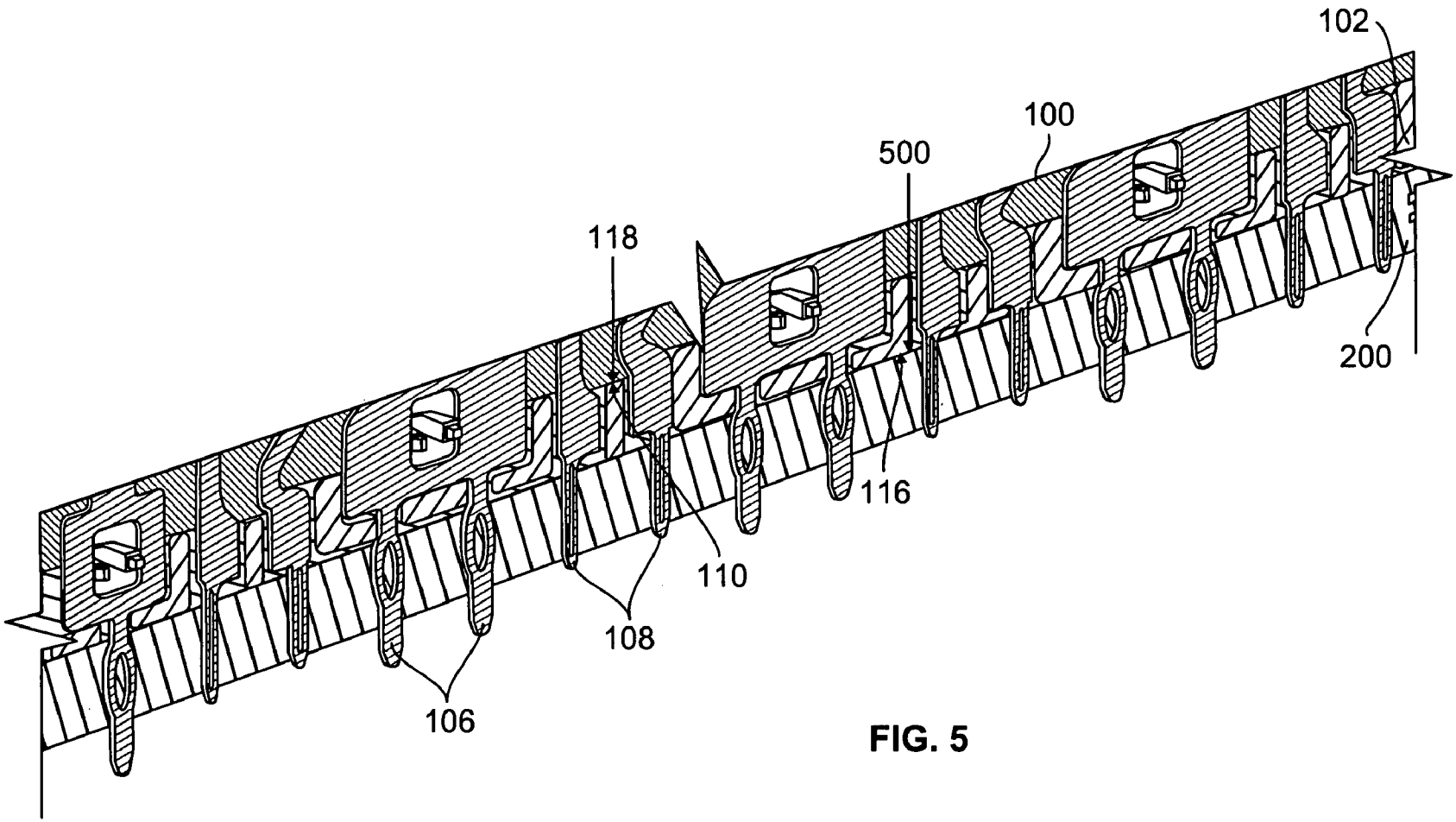
FIG. 5 is cross-sectional view of the connector assembly shown in FIG. 1.

The circuit board 200 includes a plurality of the signal contact cavities 202 and a plurality of the ground contact cavities 204. While the signal and ground contact cavities 202, 204 are shown as completely extending through the circuit board 200, in an alternative embodiment one or more of the signal and ground contact cavities 202, 204 partially extend through the circuit board 200. Each of the signal and ground contact cavities 202, 204 receives a corresponding one of the signal and ground contacts 108, 106 when the connector assembly 100 is in a seated position with respect to the circuit board 200, as shown in FIG. 5. The signal and ground contact cavities 202, 204 receive the signal and ground contacts 108, 106 to electrically connect the signal and ground contacts 108, 106 to one or more conductive traces (not shown) in the circuit board 200. For example, the signal contact cavities 202 may electrically connect the signal contacts 108 with one or more conductive traces in the circuit board 200 that are configured to communicate data signals and/or power between the connector assembly 100 and the circuit board 200. The ground contact cavities 204 may electrically connect the ground contacts 106 with one or more conductive traces in the circuit board 200 that are configured to electrically connect the ground contacts 106 with an electrical ground.

The contact organizer 102 includes a plurality of signal contact channels 206 and a plurality of ground contact channels 208. Each of the signal and ground contact channels 206, 208 extend between the top and bottom sides 118, 116 of the contact organizer 102. In the illustrated embodiment, the signal contact channels 206 extend between a common top side opening 210 on the top side 118 and a plurality of bottom side openings 212 on the bottom side 116. Alternatively, each of the signal contact channels 206 extends between a single top side opening 210 and a single bottom side opening 212. In another embodiment, each of the signal contact channels 206 extends between a plurality of top side openings 210 and a single bottom side opening 212. The signal contact channels 206 receive the signal contacts 108 through the top side openings 210.

In the illustrated embodiment, the ground contact channels 208 extend between a common top side opening 214 on the top side 118 and a plurality of bottom side openings 216 on the bottom side 116. Alternatively, each of the ground contact channels 208 extends between a single top side opening 214 and a single bottom side opening 216. In another embodiment, each of the ground contact channels 208 extends between a plurality of top side openings 214 and a single bottom side opening 216. The ground contact channels 208 receive the ground contacts 106 through the top side openings 214.

Figure 3:
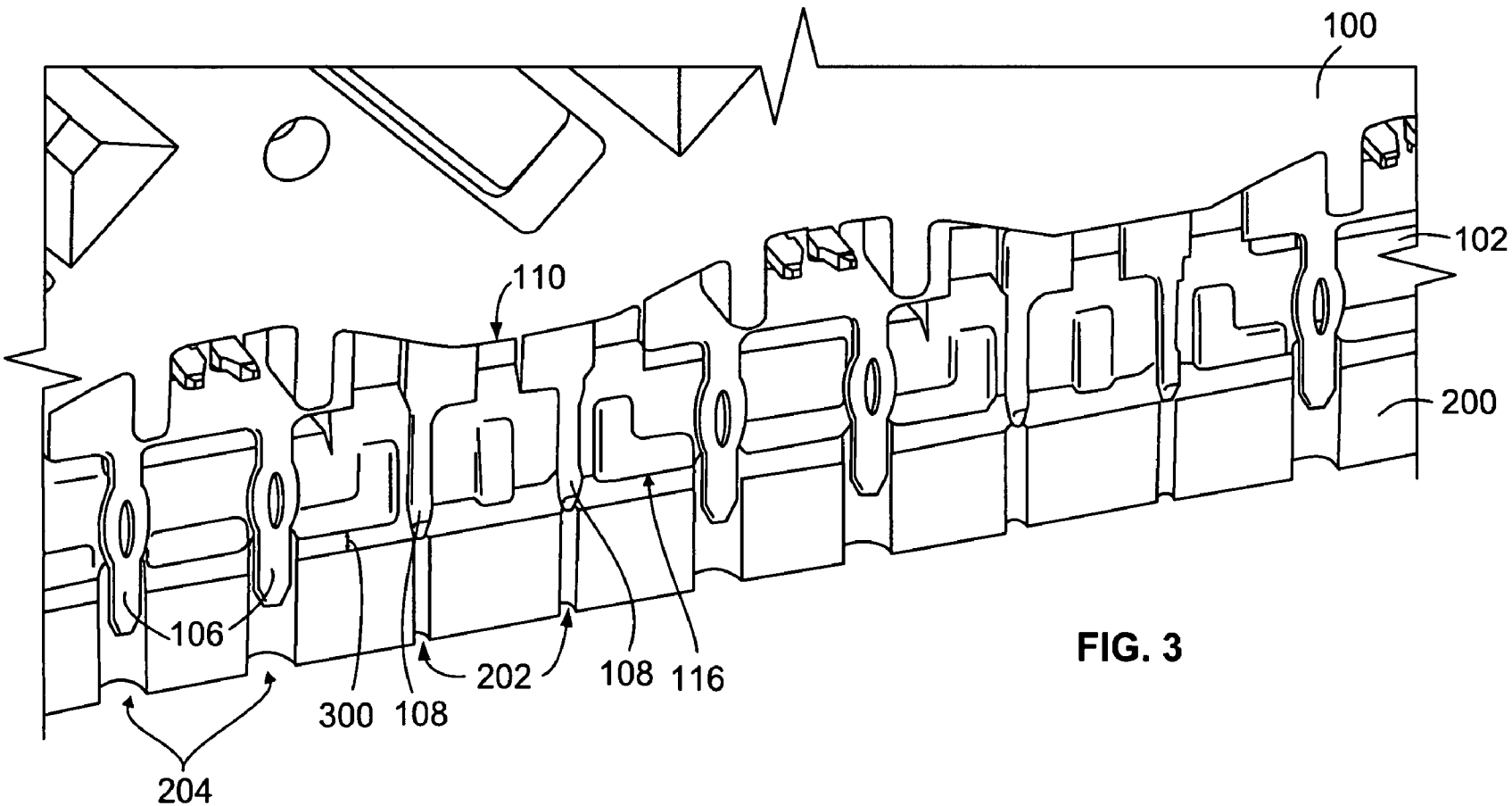
FIG. 3 is another partial cut-away view of the connector assembly, the contact organizer and the circuit board shown in FIG. 1.

FIG. 3 is a partial cut-away view of the connector assembly 100, the contact organizer 102 and the circuit board 200 with the ground contacts 106 partially inserted into the ground contact cavities 204. FIG. 3 illustrates the connector assembly 100 and the contact organizer 102 just prior to mounting the connector assembly 100 to the circuit board 200. The connector assembly 100 is mounted to the circuit board 200 by inserting the ground and signal contacts 106, 108 into the ground and signal contact cavities 204, 202. Because the ground contacts 106 extend a greater distance 220 (shown in FIG. 2) from the mounting end 110 of the connector assembly 100 than the distance 222 (shown in FIG. 2) that the signal contacts 108 extend from the mounting end 110, the ground contacts 106 are inserted into the ground contact cavities 204 before the signal contacts 108 reach or are inserted into the signal contact cavities 202. Once the ground contacts 106 are at least partially inserted into the ground contact cavities 204, the contact organizer 102 aligns the signal contacts 108 with respect to the signal contact cavities 202. For example, the connector assembly 100 can continue to move towards the circuit board 200 to further seat the ground contacts 106 in the ground contact cavities 204. Due to the differences between the distances 220, 222 that the ground contacts 106 and signal contacts 108 extend from the mounting end 110, a gap 300 exists between the bottom side 116 of the contact organizer 102 and the circuit board 200 when the ground contacts 106 are initially inserted into the ground contact cavities 204 but prior to inserting the signal contacts 108 into the signal contact cavities 202.

Figure 4:
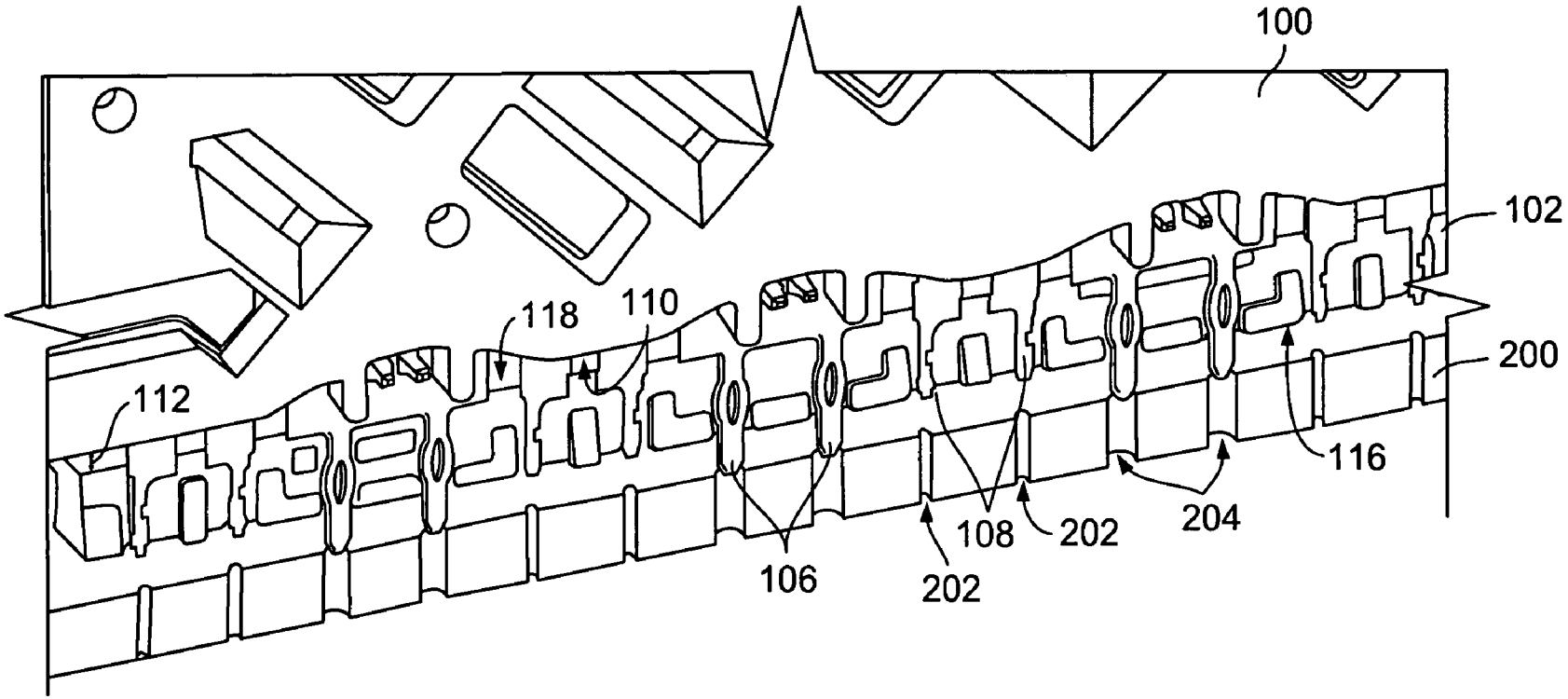
FIG. 4 is another partial cut-away view of the connector assembly, the contact organizer and the circuit board shown in FIG. 1.

FIG. 4 is a partial cut-away view of the connector assembly 100, the contact organizer 102 and the circuit board 200 with the bottom side 116 of the contact organizer 102 directly contacting the circuit board 200. As shown in FIG. 4, the connector assembly 100 has been partially seated in the circuit board 200 by inserting the ground contacts 106 in the ground contact cavities 204 until the bottom side 116 directly contacts or engages the circuit board 200. The contact organizer 102 mechanically supports and aligns the signal contacts 108 such that the signal contacts 108 do not bend or buckle when the signal contacts 108 are initially inserted into the signal contact cavities 202. For example, the signal contacts 108 may be smaller or thinner than the ground contacts 106. As a result, the signal contacts 108 may be more prone to bending or buckling if the signal contacts 108 are not otherwise supported or properly aligned with the signal contact cavities 202.

In the illustrated embodiment, at least part of the gap 112 between the top side 118 of the contact organizer 102 and the mounting end 110 of the connector assembly 110 remains as the connector assembly 100 is seated in the circuit board 200 when the signal contacts 108 are initially inserted in the signal contact cavities 202. For example, at least a portion of the contact organizer 102 does not directly contact or engage the mounting end 110 when the connector assembly 100 is seated in the circuit board 200 sufficiently far such that the signal contacts 108 are proximate to the circuit board 200 just prior to being inserted into the signal contact cavities 202.

FIG. 5 is cross-sectional view of a portion of the connector assembly 100 proximate to the mounting end 110 in a seated position in the circuit board 200. As shown in FIG. 5, the ground and signal contacts 106, 108 are received in, and electrically connected to, the ground and signal contact cavities 204, 202 (shown in FIG. 2) when the connector assembly 100 is in the seated position. In the seated position, the contact organizer 102 is sandwiched between the connector assembly 100 and the circuit board 200. For example, the top side 118 of the contact organizer 102 directly contacts the mounting end 110 of the connector assembly 100 and the bottom side 116 of the contact organizer 102 directly contacts a top surface 500 of the circuit board 200. In one embodiment, no gap exists between the mounting end 110 and the top side 118 and no gap exists between the bottom side 116 and the top surface 500. In, another embodiment, at least a portion of the top side 118 directly contacts at least a portion of the mounting end 110 and at least a portion of the bottom side 116 contacts at least a portion of the top surface 500.

The contact organizer 102 moves relative to the ground and signal contacts 106, 108 as the connector assembly 100 is mounted to the circuit board 200. For example, the contact organizer 102 may slide along the ground and signal contacts 106, 108 as the connector assembly 102 is seated in the circuit board 200 beyond the position shown in FIG. 4. The ground and signal contact channels 204, 202 slide relative to the ground and signal contacts 106, 108 as the contact organizer 102 slides relative to the ground and signal contact channels 204, 202. The contact organizer 102 provides mechanical support to the ground and signal contacts 106, 108 as the contact organizer 102 slides relative to the connector assembly 100. In one embodiment, the signal contacts 108 are less likely to bend or buckle due to the contact organizer 102 aligning the signal contacts 108 with the signal contact cavities 202 and supporting the signal contacts 108.

In one embodiment, the contact organizer 102 improves signal integrity of the signal contacts 108 by controlling system impedance and by reducing crosstalk between the signal contacts 108. The contact organizer 102 may control the impedance of the connector system 10 (shown in FIG. 1) such that the impedance of the connector system 10 is approximately the same throughout the connector system 10. For example, the contact organizer 102 controls the impedance of the connector system 10 by matching the impedance between the mounting end 110 of the connector assembly 100 and the circuit board 200 to the impedance of the remainder of the connector assembly 100 in one embodiment.

Figure 6:
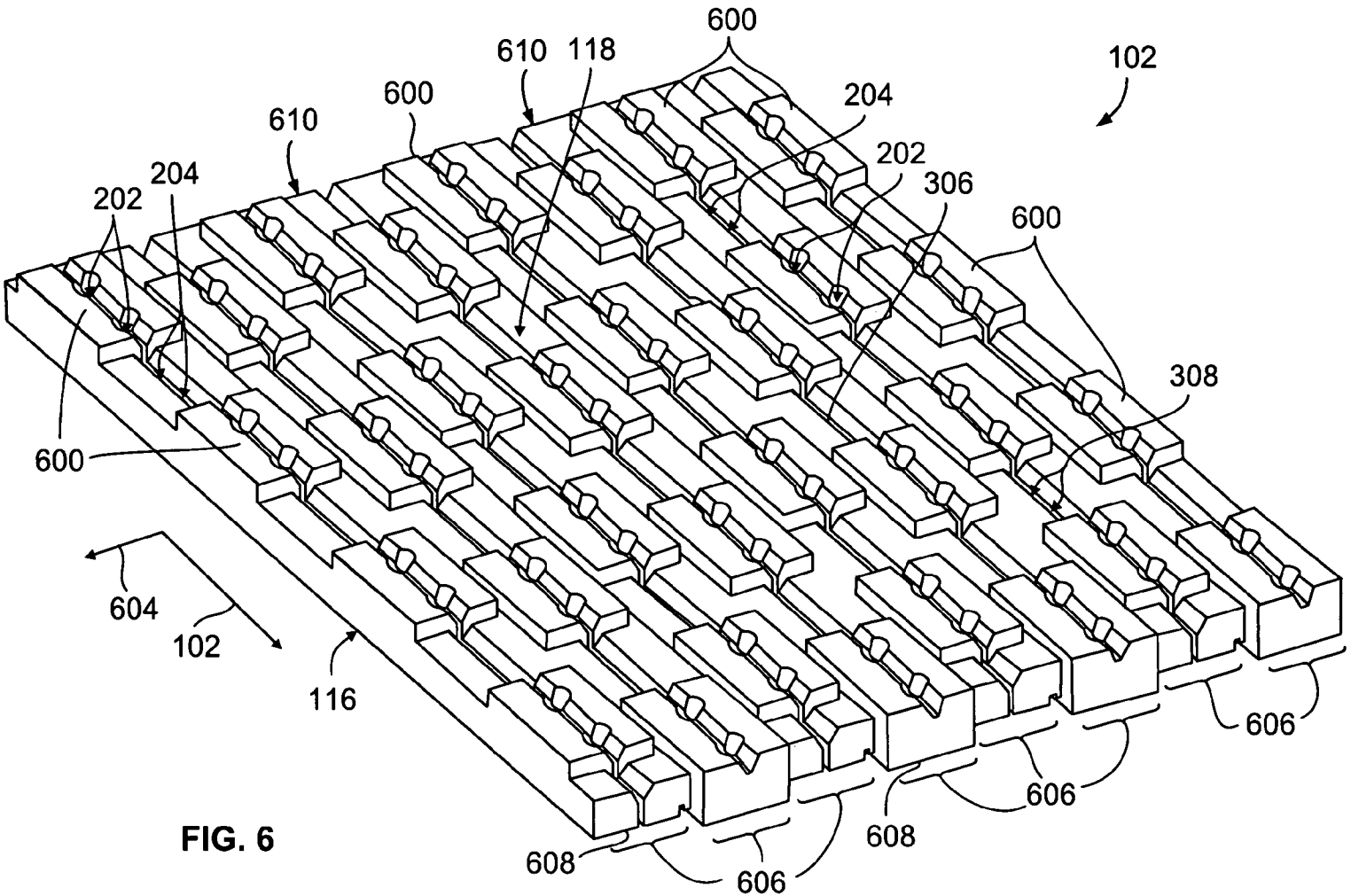
FIG. 6 is a perspective view of the contact organizer shown in FIG. 1 according to one embodiment.

FIG. 6 is a perspective view of the contact organizer 102 according to one embodiment. The contact organizer 102 is substantially planar in a plane defined by the longitudinal direction 102 and a lateral direction 604. When assembled, the contact organizer 102 is substantially parallel to the mounting ends 110 (shown in FIG. 1) of the chicklets 104 (shown in FIG. 1). For example, the longitudinal direction 602 may be substantially parallel to the longitudinal direction 120 (shown in FIG. 1) of the chicklets 104 (shown in FIG. 1) and the lateral direction 604 may be substantially perpendicular to the longitudinal and transverse directions 120, 122 (shown in FIG. 1) of the chicklets 104. The contact organizer 102 extends between opposing ends 608, 610 along the longitudinal direction 602. The top surface 118 of the contact organizer 102 includes a shape that is complementary to the mounting end 110 (shown in FIG. 1) of the connector assembly 100 (shown in FIG. 1). For example, the top surface 118 may be substantially planar with a plurality of protrusions 600 that extend upwards from the top surface 118, with the protrusions 600 being positioned to be inserted into cavities or other recesses (not shown) in the mounting end 110 when the connector assembly 100 and the contact organizer 102 are in the seated position shown in FIG. 5. While the protrusions 600 are substantially identical in FIG. 6, a plurality of the protrusions 600 may differ in size, shape and/or position with respect to one another in another embodiment. The protrusions 600 may have a rectangular shape that is elongated along the longitudinal direction 602.

The contact organizer 102 may be arranged as a plurality of strips 606 that each extends along the longitudinal direction 602 between the opposing ends 608, 610. Each strip 606 includes a plurality of the signal and ground contact cavities 202, 204. In the illustrated embodiment, the signal contact cavities 202 extend through the protrusions 600 in each strip 606. In another embodiment the ground contact cavities 204 extend through the protrusions 600. In another embodiment, neither the signal nor the ground contact cavities 202, 204 extends through the protrusions 600. The strips 606 may be arranged such that each strip 606 corresponds to one of the chicklets 104 (shown in FIG. 1) of the connector assembly 100 (shown in FIG. 1). For example, the signal and ground contact cavities 202, 204 in each strip 606 may receive the signal and ground contacts 106, 108 from a single chicklet 104. The strips 606 may be integrally formed with one another. For example, the strips 606 may be homogeneously formed with one another. In another embodiment, the strips 606 may be separately formed and then mechanically coupled together.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

What is claimed is:

1. A connector system comprising:

a connector assembly having a mounting end, the connector assembly comprising first and second contacts protruding from the mounting end to mate with a circuit board, the first contacts protruding from the mounting end a greater distance than the second contacts; and a contact organizer comprising a top side, a bottom side and channels extending between the top and bottom sides, the contact organizer being movable with respect to the connector assembly to receive the first and second contacts in the channels, wherein the first contacts are received in the channels of the contact organizer prior to the second contacts such that the first contacts guide the second contacts into corresponding channels of the contact organizer.

2. The connector system of claim 1, wherein the contact organizer is moveable with respect to the connector assembly between a supporting position and a seated position and, when the contact organizer is in the supporting position, the first contacts extend through the contact organizer, protrude from the bottom side, and are partially seated in the circuit board, the second contacts partially extend into the contact organizer without protruding from the bottom side, and the bottom side engages the circuit board, further wherein, when the contact organizer is in the seated position, the first and second contacts extend through the contact organizer, protrude from the bottom side, are seated in the circuit board and the bottom side engages the circuit board.

3. The connector system of claim 1, wherein the contact organizer prevents the second contacts from buckling as the connector assembly is mounted to the circuit board and the contact organizer slides along the first and second contacts toward the mounting end of the connector assembly.

4. The connector system of claim 1, wherein the contact organizer controls an impedance between the mounting end of the connector assembly and the circuit board.

5. The connector system of claim 2, wherein a gap is provided between the top side and the mounting end when the contact organizer is in the supporting position.

6. The connector system of claim 1, wherein a plurality of the channels merge into a single channel between the top side and the bottom side of the contact organizer.

7. The connector system of claim 1, wherein the contact organizer includes protrusions upwardly extending from the top side toward the mounting end of the connector assembly, the protrusions and the top side of the contact organizer having a complementary shape to and engaging the mounting end of the connector assembly.

8. The connector system of claim 7, wherein the channels that receive the second contacts extend through the protrusions of the contact organizer such that the second contacts are received into the protrusions.

9. The connector system of claim 1, wherein the connector assembly comprises contact chicklets with each of the contact chicklets holding a subset of the first and second contacts, and the contact organizer is divided into elongated strips with each strip including a subset of the channels, further wherein each of the elongated strips receives the first and second contacts of a different one of the contact chicklets.

10. A connector system comprising:

a connector assembly comprising a mounting end and configured to be mounted to a circuit board, the connector assembly comprising contact chicklets each holding first and second contacts protruding from the mounting end, the first contacts protruding farther from the mounting end than the second contacts; and a contact organizer extending between opposite top and bottom sides and comprising channels extending between the top and bottom sides, the contact organizer receiving the first and second contacts from the contact chicklets such that the contacts extend through the channels to mate with the circuit board, the top side of the contact organizer including protrusions upwardly extending from the top side toward the mounting end of the connector assembly, wherein the protrusions and the top side have a shape that is complementary to the mounting end.

11. The connector system of claim 10, wherein the first contacts are received in the channels of the contact organizer prior to the second contacts such that the first contacts guide the second contacts into corresponding channels of the contact organizer.

12. The connector system of claim 10, wherein the contact organizer prevents the second contacts from buckling as the connector assembly is mounted to the circuit board and the contact organizer slides along the first and second contacts.

13. The connector system of claim 10, wherein prior to mounting the connector assembly to the circuit board, the first contacts extend through the contact organizer, protrude from the bottom side, and are partially inserted into the channels, the second contacts partially extend into the contact organizer without protruding from the bottom side, and a gap is provided between the top side and the mounting end.

14. The connector system of claim 10, wherein a plurality of the channels merge into a single channel between the top side and the bottom side of the contact organizer.

15. The connector system of claim 10, wherein the channels that receive the second contacts extend through the protrusions of the contact organizer such that the second contacts are received into the protrusions.

16. The connector system of claim 10, wherein the connector assembly comprises contact chicklets with each of the contact chicklets holding a subset of the first and second contacts, and the contact organizer is divided into elongated strips with each strip including a subset of the channels, further wherein each of the elongated strips receives the first and second contacts of a different one of the contact chicklets.

17. A contact organizer configured to receive contacts protruding from mounting ends of contact chicklets of a connector assembly that mates with a circuit board, the contact organizer comprising a body having a top side, a bottom side opposite to the top side, and channels extending between the top and bottom sides and configured to receive the contacts, the body divided into elongated strips with each of the strips including a subset of the channels, the channels oriented to align the contacts with respect to cavities in the circuit board, wherein each of the elongated strips receives the contacts of a different one of the contact chicklets.

18. The contact organizer of claim 17, wherein the contact organizer controls an impedance of the connector assembly between the mounting end of the connector assembly and the circuit board.

19. The contact organizer of claim 17, wherein the contact organizer prevents a plurality of the contacts from buckling as the connector assembly is mounted to the circuit board and the contact organizer slides along the contacts.

20. The contact organizer of claim 17, wherein the strips include protrusions upwardly extending from the top side, the protrusions including a subset of the channels such that a subset of the contacts are received into the channels in the protrusions prior to a different subset of the contacts being received into the channels disposed outside of the protrusions.

* * * * *